United States Patent [19]

Hendricks et al.

[11] 4,297,103

[45] Oct. 27, 1981

[54] PROCESS FOR THE CONTINUOUS ONE-BATH DYEING OF PILE FABRICS MADE OF POLYACRYLONITRILE/COTTON

[75] Inventors: Udo-Winfried Hendricks, Odenthal; Klaus Wollny, Monheim, both of Fed. Rep. of Germany

[73] Assignee: Bayer Aktiengesellschaft, Leverkusen, Fed. Rep. of Germany

[21] Appl. No.: 88,680

[22] Filed: Oct. 26, 1979

[30] Foreign Application Priority Data

Nov. 16, 1978 [DE] Fed. Rep. of Germany ..... 2849667

[51] Int. Cl.[3] ..... D06P 3/87

[52] U.S. Cl. ..... 8/534; 8/603; 8/582

[58] Field of Search ..... 8/21 A, 1 B, 534

[56] References Cited

U.S. PATENT DOCUMENTS

| | | | |
|---|---|---|---|
| 3,493,981 | 2/1970 | Noda et al. | 8/927 |
| 3,706,524 | 12/1972 | Flensberg et al. | 8/21 A |
| 3,900,283 | 8/1975 | Hildebrand et al. | 8/21 A |

FOREIGN PATENT DOCUMENTS

| | | | |
|---|---|---|---|
| 40-9074 | 5/1965 | Japan | 8/21 A |
| 986034 | 3/1965 | United Kingdom | 8/21 A |
| 1298703 | 12/1972 | United Kingdom . | |

OTHER PUBLICATIONS

Bayer Farben, Nr. 25 (1975) pp. 56–71.

*Primary Examiner*—Joseph L. Schofer
*Assistant Examiner*—Maria Parrish Tungol
*Attorney, Agent, or Firm*—Sprung, Felfe, Horn, Lynch & Kramer

[57] ABSTRACT

Process for the continuous one-bath dyeing of pile fabrics made of acrylic fibres in the pile with a cotton base fabric by the pad-steam process with basic and substantive dyestuffs, characterized in that salts of alkyl sulphates of the general formula $$R-O-SO_3^{\ominus}M^{\oplus}$$

in which

R represents a straight-chain or branched alkyl radical with 10–16 carbon atoms and M represents an alkali metal, alkaline earth metal, ammonium, alkylammonium or alkanolammonium ion, are used as auxiliaries in the dyebath.

4 Claims, No Drawings

PROCESS FOR THE CONTINUOUS ONE-BATH DYEING OF PILE FABRICS MADE OF POLYACRYLONITRILE/COTTON

The invention relates to a process for the continuous dyeing of pile fabrics made of acrylic fibres in the pile with a cotton base fabric by the pad-steam process with basic and substantive dyestuffs.

The continuous dyeing of pile fabrics of this type, especially furnishing velours, with basic and substantive dyestuffs by continuous processes is known (see H. Gerber, H. Lehmann and F. Somm Melliand 54(1973), 77–82; J. Soc. Dyers and Colourists 87 (1971), 458–462 and G. Früh Melliand 55 (1974), 275–278).

According to these processes, the textile material is padded with an aqueous formulation which contains basic dyestuffs for the acrylic fibre constituent and substantive dyestuffs for the cotton constituent. In order to prevent mutual precipitation of the two types of dyestuff, certain auxiliaries must be used: by adding an anionic auxiliary, an adduct is formed from the basic dyestuffs and the anionic auxiliary and this has to be dispersed by a non-ionic auxiliary. The textile material impregnated with the dye liquor is then steamed. On steaming, the adduct of the basic dyestuff and the anionic auxiliary splits and both dyestuffs are fixed on the corresponding fibres.

In Bayer Farben Revue Nr. 25 (1975), page 56–71 it is further stated that if a dyeing accelerator is also used for dyeing polyacrylonitrile fibres, the addition of a non-ionic auxiliary is superfluous.

The invention now relates to a process for the continuous one-bath dyeing of pile fabrics made of acrylic fibres in the pile with a cotton base fabric by the pad-steam process with basic and substantive dyestuffs, in which process salts of alkyl sulphates of the general formula $$R—O—SO_3^{\ominus}M^{\oplus} \quad (I)$$

in which

R represents a straight-chain or branched alkyl radical with 10–16 carbon atoms and M represents an alkali metal, alkaline earth metal, ammonium, alkylammonium or alkanolammonium ion, are used as auxiliaries.

Salts of alkyl sulphates of the general formula (I) which may be mentioned are the sodium, potassium, ammonium and methylammonium salts and preferably the mono-, di- and tri-ethanolammonium salts of the acid sulphuric acid esters of decanol, dodecanol, tetradecanol and hexadecanol or mixtures thereof or of the acid sulphuric acid esters of mixtures of industrial, optionally branched alcohols with 10–16 carbon atoms.

It has been found that, with the process claimed, particularly good results can be achieved if the salts of alkyl sulphates are used together with dyeing accelerators for dyeing polyacrylonitrile fibres.

Suitable dyeing accelerators are compounds which are able to swell the polyacrylonitrile fibres. Compounds of this type are described, for example, in German Offenlegungsschrift (German Published Specification) No. 1,619,550, German Auslegeschrift (German Published Specification) No. 1,958,472, German Auslegeschrift (German Published Specification) No. 2,005,675, German Auslegeschrift (German Published Specification) No. 2,005,676 and U.S. Pat. No. 3,493,981. Preferably, aliphatic, cycloaliphatic and aromatic nitriles, which can be optionally substituted and/or can contain herteroatoms and/or functional groups, are used in the process claimed. Examples which may be mentioned are acetonitrile, propionitrile, 3-phenoxypropionitrile, 3-cresyloxypropionitrile, benzonitrile, phenylacetonitrile, benzyloxypropionitrile, phthalic acid dinitrile, succinic acid dinitrile, 2-cyanoethyl benzoate, di-(2-cyanoethyl) phthalate and 3-(phenoxyethoxy)-propionitrile. In particular, benzyloxypropionitrile is used.

The nitriles are preferably added to the dyebath together with commercially available anionic and/or non-ionic emulsifiers, in order to obtain uniform dispersion in the case of nitriles which are insoluble or sparingly soluble in water.

The amounts in which the compounds are employed can vary within wide limits; the most advantageous amounts can be determined easily by preliminary experiments. Preferably, 2.0–15 g/l of (I) and 10–30 g/l of the nitrile are employed.

In addition to the said auxiliaries, agents customarily used for this dyeing process can also be used, for example thickeners, solvents and anti-foam agents.

Compared with auxiliaries used hitherto, a stability of the padding liquors which has not been achieved hitherto is achieved with the process claimed, especially when dyeing in deep colour shades with high concentrations of anionic and cationic dyestuffs.

As a further advantage, a distinct increase in the dyestuff yield is achieved, as can be shown by colorimetric tests.

The improved fixation of the dyestuff, which is achieved at the same time, results, especially when dyeing in dark colour shades, in fastnesses to rubbing such as have not been achieved hitherto.

A further important advantage is the accelerated fixing of the dyestuffs, which permits an increased speed of the goods on the continuous dyeing installations and, associated therewith, increased production speeds.

Examples of the dyestuffs to be used according to the invention are described in the "Colour Index", 3rd edition (1971) and in particular examples of the basic dyestuffs are described on pages 1611–1688 of volume 1 and examples of the substantive dyestuffs are described on pages 2007–2477 of volume 2.

The names of the dyestuffs given in the examples which follow have been taken from these volumes of the "Colour Index".

EXAMPLE 1

3 g of a carob bean flour thickener, which has been mixed to a suspension with methanol in a ratio of 1:1, are stirred in 0.5 liter of water. 2.5 g of the compound $$C_{12}H_{25}—O—SO_3^{\ominus}H_3N^{\oplus}—CH_2—CH_2—OH$$

are then added.

1.3 g of Direct Yellow 50 (C.I. 29 025) in the form of an aqueous solution are then added to this liquor.

1 g of Basic Yellow 21 in the form of an aqueous solution is then stirred in and the liquor is made up to 1 with water.

A piece of pile fabric, which consists of polyacrylonitrile pile and cellulose backing and weighs about 10 g, is impregnated with this dye liquor and squeezed off to a liquor pick-up of 150%. It is then steamed in saturated steam for 10 minutes at 100° C., washed out and dried. A yellow dyeing with good fastness to rubbing is obtained.

EXAMPLE 2

A dye liquor is prepared by the procedure described in Example 1, using: 3 g/l of carob bean flour, 5 g/l of the ethanolammonium salt of a sulphated industrial mixture of alcohols with 10–14 carbon atoms, 8.5 g/l of benzyloxypropionitrile, 3.5 g/l of an anionic emulsifier, 3.5 g/l of Direct Blue 71 (C.I. 34 140) and 1.5 g/l of Basic Blue 69.

On dyeing pile fabric, a blue dyeing with excellent fastness properties to rubbing is obtained.

EXAMPLE 3

A dye liquor is prepared by the process described in Example 1, using: 3 g/l of thickener, 5 g/l of the compound of the formula $C_{12}H_{25}—O—SO_3^{\ominus}H_2N(CH_2—CH_2—OH)_2$, 8.5 g/l of benzyloxypropionitrile, 3.5 g/l of an anionic emulsifier, 6.4 g/l of Direct Red 79 (C.I. 29 065) and 6.0 g/l of Basic Red 22 (C.I. 11 055(S)).

A red dyeing with very good fastness properties to rubbing is obtained.

EXAMPLE 4

6 g of a carob bean flour thickener, which has been mixed to a suspension with methanol in a ratio of 1:2, are stirred in one liter of water. 14 g of the compound $$C_{12}H_{25}—O—SO_{3u}^{\ominus}H_3N^{\oplus}—CH_2—CH_2—OH$$

and a mixture of 24 g of benzyloxypropionitrile and 9.2 g of an anionic emulsifier are then added.

1.8 g of Direct Orange 39, 8.1 g of Direct Orange 40, 0.5 g of Direct Blue 71 and 2 g Direct Red 80, in the form of an aqueous solution, are added to this liquor.

Subsequently, 4 g of Basic Yellow 21, 7 g of Basic Yellow 29, 5.2 g of Basic Yellow 28, 3 g of Basic Red 22, 1 g of Basic Blue 69 and also 0.5 g of Basic Blue 62 and 1 g of Basic Green 4, in the form of an aqueous solution, are stirred in and the liquor is made up to 2 l with water.

A piece of pile fabric, which consists of polyacrylonitrile pile and cellulose backing and weighs about 20 g, is impregnated with this dye liquor and squeezed off to a liquor pick-up of 150%. It is then steamed in saturated steam for 10 minutes at 100° C., washed out and dried. A deep brown dyeing with good fastness to rubbing is obtained.

We claim:

1. In the continuous one-bath dyeing of a pile fabric composed of a cotton base and an acrylic pile comprising padding the fabric with a dyebath containing a basic dyestuff and a substantive dyestuff, and thereafter steaming the fabric to effect dyeing, the improvement which comprises including in the dyebath a nitrile which swells the acrylic fiber and a salt of an alkyl sulphate of the formula $$R'—O—SO_3^{\ominus}M^{\oplus}$$

in which

R′ is alkyl with 10 to 16 carbon atoms, and

M is an alkali metal, alkaline earth metal, ammonium, alkylammonium or hydroxyalkylammonium ion.

2. A process according to claim 1, in which

R′ is alkyl with 12 to 14 carbon atoms, and

M is an alkylammonium or hydroxyalkylammonium ion.

3. A process according to claim 1, wherein the nitrile is selected from the group consisting of acetonitrile, propionitrile, 3-phenoxy-propionitrile, 3-cresyloxypropionitrile, benzonitrile, phenylacetonitrile, benzyloxypropionitrile, phthalic acid dinitrile, succinic acid dinitrile, 2-cyanoethyl benzoate, di-(2-cyanoethyl) phthalate and 3-(phenoxy-ethoxy)-propionitrile.

4. A process according to claim 1, wherein the nitrile is benzyloxypropionitrile.

* * * * *